US007021376B2

(12) United States Patent
Bayliss et al.

(10) Patent No.: US 7,021,376 B2
(45) Date of Patent: Apr. 4, 2006

(54) METHOD FOR PLACEMENT OF BLOCKING GELS OR POLYMERS AT MULTIPLE SPECIFIC DEPTHS OF PENETRATION INTO OIL AND GAS, AND WATER PRODUCING FORMATIONS

(76) Inventors: Geoffrey Stanley Bayliss, 703 Calthorte, Katy, TX (US) 77450; Paul Stuart Bayliss, 1303 Brook Grove Dr., Katy, TX (US) 77450

( * ) Notice: Subject to any disclaimer, the term of this patent is extended or adjusted under 35 U.S.C. 154(b) by 241 days.

(21) Appl. No.: 10/679,104

(22) Filed: Oct. 6, 2003

(65) Prior Publication Data

US 2004/0118559 A1 Jun. 24, 2004

Related U.S. Application Data

(60) Continuation-in-part of application No. 10/217,256, filed on Aug. 12, 2002, now Pat. No. 6,615,918, which is a division of application No. 09/824,403, filed on Apr. 2, 2001, now Pat. No. 6,431,280, which is a continuation-in-part of application No. 09/217,474, filed on Dec. 21, 1998, now abandoned.

(51) Int. Cl.
*E21B 33/138* (2006.01)

(52) U.S. Cl. ..... 166/263; 166/292; 166/294; 166/300

(58) Field of Classification Search ..... 166/263, 166/270, 292, 294, 300; 516/111; 523/130, 523/131

See application file for complete search history.

(56) References Cited

U.S. PATENT DOCUMENTS 2,747,670 A 5/1956 King et al.
2,779,416 A 1/1957 Clark, Jr.
3,022,825 A * 2/1962 Winsauer et al. ..... 166/295
RE25,747 E * 3/1965 Hilton, Jr. et al. ..... 166/295
3,297,089 A * 1/1967 Spain ..... 166/295
3,396,790 A * 8/1968 Eaton ..... 166/270
3,419,073 A * 12/1968 Brooks, Jr. ..... 166/295
3,428,122 A * 2/1969 Methven et al. ..... 166/295
3,502,146 A 3/1970 Hurd
3,522,844 A 8/1970 Abdo
3,530,937 A 9/1970 Bernard
3,623,842 A 11/1971 Deans
3,747,677 A 7/1973 Richardson et al.
3,749,174 A * 7/1973 Friedman et al. ..... 166/294
3,841,405 A 10/1974 Monta et al.
3,876,438 A * 4/1975 Friedman et al. ..... 252/8.05
4,031,958 A 6/1977 Sandiford et al.
4,042,031 A * 8/1977 Knapp ..... 166/276
4,287,951 A 9/1981 Sydansk et al.
4,312,635 A 1/1982 Carlisle
4,361,186 A 11/1982 Kalina
4,428,424 A 1/1984 Lacy et al.
4,488,601 A 12/1984 Hammett
4,494,606 A * 1/1985 Sydansk ..... 166/295

(Continued)

*Primary Examiner*—George Suchfield
(74) *Attorney, Agent, or Firm*—Kurt S. Myers

(57) ABSTRACT

This patent relates to a process whereby two, or more, filter/sieves or water blockages are produced by injecting the interactive chemicals used to form gels and polymers at reservoir temperatures independently and sequentially into a well in such a manner that the chemicals only come into contact with each other at the desired depth of penetration in the formation. At this location in the reservoir, which can be determined by appropriate calculation, the injection is stopped and the intermixed and superimposed chemicals are allowed to react to form the filter/sieves of a gel or polymer depending upon the nature of the individual chemicals injected.

7 Claims, 3 Drawing Sheets

U.S. PATENT DOCUMENTS

| | | | | |
|---|---|---|---|---|
| 4,552,217 | A | 11/1985 | Wu et al. | |
| 4,569,393 | A | 2/1986 | Bruning et al. | |
| 4,630,678 | A | 12/1986 | Mumallah et al. | |
| 4,662,449 | A | 5/1987 | Friedman | |
| 4,665,986 | A | 5/1987 | Sandiford | |
| 4,708,207 | A | 11/1987 | Kalfayan et al. | |
| 4,917,186 | A | 4/1990 | Mumallah | |
| 5,067,564 | A | 11/1991 | Sydansk | |
| 5,944,106 | A | 8/1999 | Dalrymple et al. | |
| 5,979,557 | A | 11/1999 | Card et al. | |
| 6,152,234 | A | 11/2000 | Newhouse et al. | |
| 6,167,967 | B1 | 1/2001 | Sweatman | |
| 6,419,017 | B1 | 7/2002 | Metcalf et al. | |
| 6,431,280 | B1 * | 8/2002 | Bayliss et al. | 166/263 |
| 6,615,918 | B1 * | 9/2003 | Bayliss et al. | 166/263 |

* cited by examiner

Prior Art
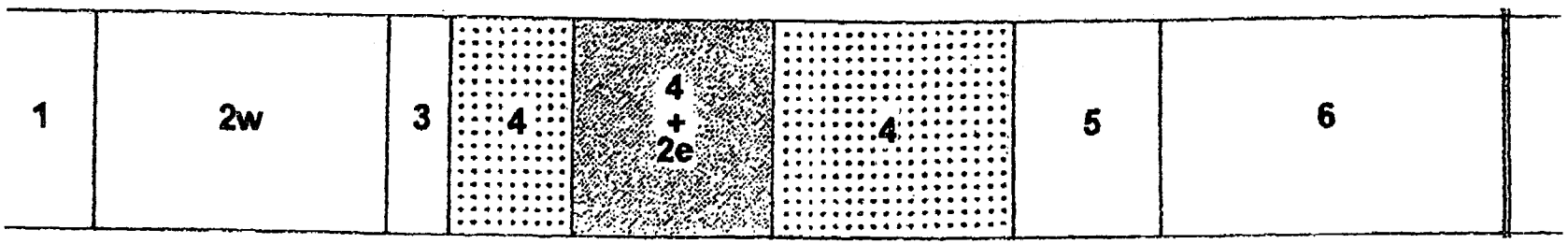
FIGURE 1-A
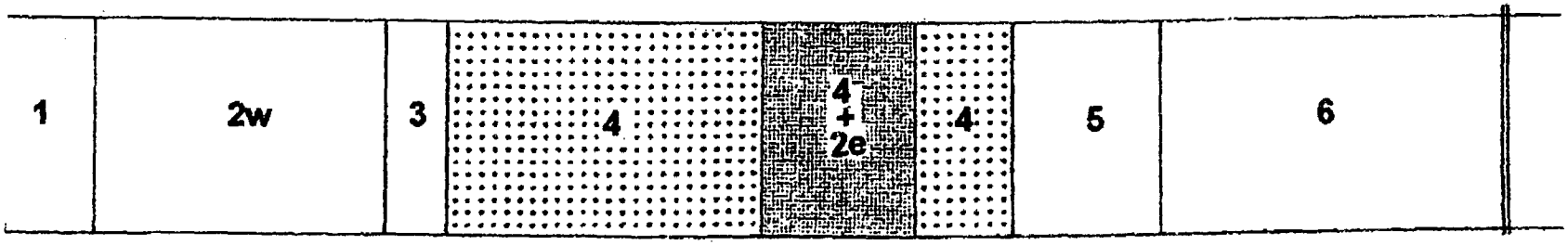
FIGURE 1-B

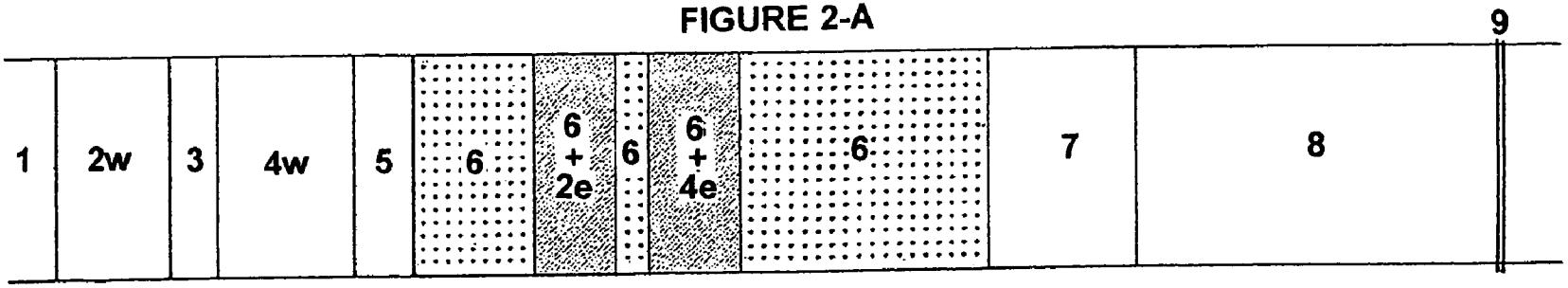
FIGURE 2-A
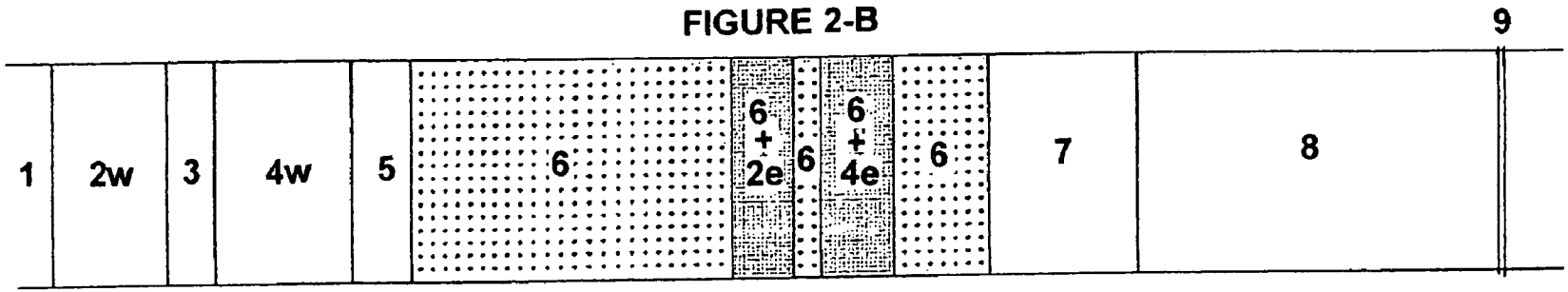
FIGURE 2-B

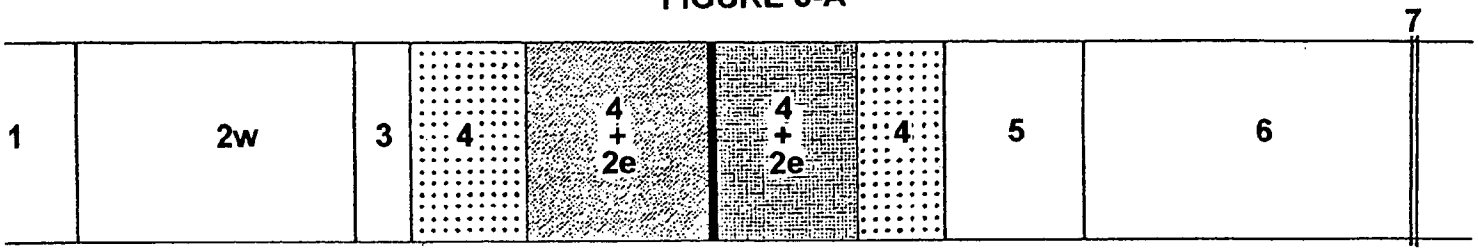
FIGURE 3-A
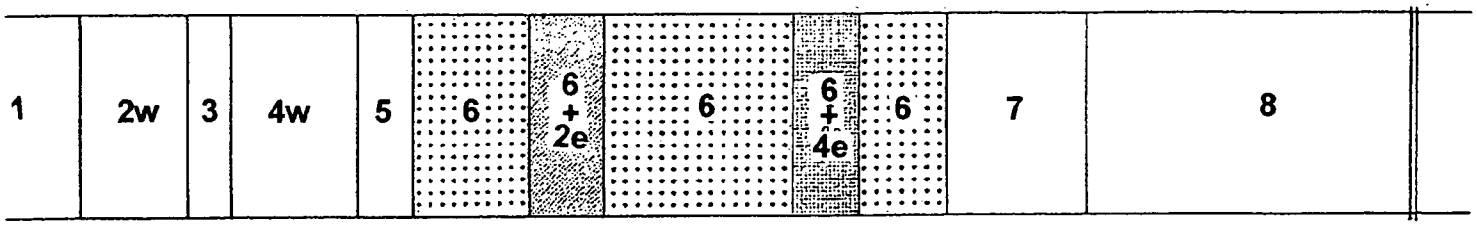
FIGURE 3-B
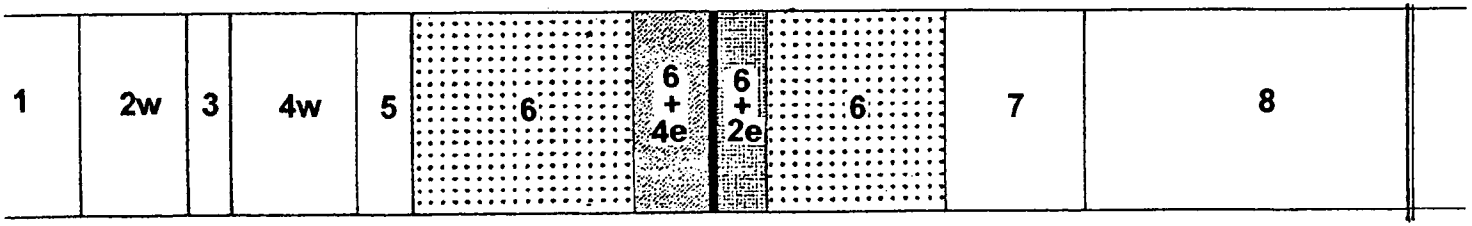
FIGURE 3-C

METHOD FOR PLACEMENT OF BLOCKING GELS OR POLYMERS AT MULTIPLE SPECIFIC DEPTHS OF PENETRATION INTO OIL AND GAS, AND WATER PRODUCING FORMATIONS

RELATED APPLICATION

This application is a continuation-in-part of U.S. application Ser. No. 10/217,256, filed Aug. 12, 2002, now U.S. Pat. No. 6,615,918, which is a division of U.S. application Ser. No. 09/824,403, filed Apr. 2, 2001, entitled "Method for Placement of Blocking Gels or Polymers at Specific Depths of Penetration into Oil and Gas, and Water Producing Formations", now U.S. Pat. No. 6,431,280; which is a continuation-in-part of U.S. application Ser. No. 09/217,474, filed Dec. 21, 1998, now abandoned entitled "Method for Placement of Blocking Gels or Polymers at Specific Depths of Penetration into Oil and Gas, and Water Producing Formations".

FIELD OF INVENTION

This invention relates to the stoppage of water flow while permitting the recovery of hydrocarbons from a hydrocarbon formation in the earth.

Specifically, it relates to the placement of two, or more, filter/sieves of blocking gels or polymers at predetermined distances from a well bore in order to stop water flow and to thereby enhance the recovery of oil and gas hydrocarbons from the formation.

BACKGROUND OF THE INVENTION

It is well known that the economic life expectancy of commercially productive oil and gas wells is determined by a transitional change with time from the well being predominantly oil and gas producing to becoming increasingly a producer of water. Another reason for the diminution of oil and gas production is the loading up of a wellbore due to formation water influx.

It is commonly known that increasing water production from the formation into the wellbore results in a situation where the weight of water in the wellbore is such that the pressure exerted by the water is greater than the producing reservoir pressure and consequentially production of oil and gas ceases.

This process is of particular interest in free flowing oil and gas wells and applies specifically to many oil and gas wells located in offshore areas.

There are well established methods to unload water from such a well either by nitrogen or inert gas injection or by coiled tubing gas lift methods; however, such methods, if applied without first stopping the incoming water problem, have little chance of sustaining the resultant oil and/or gas production for any length of time before the water influx again loads up the well and the well again becomes uneconomic.

The gel and polymer emplacement methodologies disclosed in U.S. Pat. Nos. 6,431,280 and 6,615,918, which are incorporated herein by reference, are ideally suited to stopping unwanted water flow into such normally free flowing wells prior to unloading the water.

SUMMARY OF THE INVENTION

This invention relates to a process whereby multiple filter/sieve zones are produced by injecting interactive chemicals used to form gels and polymers at reservoir temperatures independently, or commingled, and sequentially into a well in such a manner that the chemicals only come into contact with each other at the desired depths of penetration in the formation. At this location in the reservoir, which can be determined by appropriate calculation, the injection is stopped and the intermixed and superimposed chemicals are allowed to react to form the filter/sieve zones of a gel or polymer depending upon the nature of the individual chemicals injected.

Since no reaction takes place during the injection phase, premature gelation or polymerization cannot occur at any point other than where the chemicals come into contact each with the other. Furthermore, by using this placement process not only can the gel or polymer blockages, namely, the desired filter/sieve structures, be located at depths of penetration (between four and thirty feet) where the velocity flow for either the injection or production of fluids into or from the reservoir interval is ideal for maintaining the blockage of water, but the thickness of the filter/sieve or water blockage zones can also be predetermined by using appropriate volumes of the injected chemicals and nonchemical containing push and spacer volumes.

BRIEF DESCRIPTION OF THE DRAWINGS

FIG. 1A is a drawn to scale illustration of the radial distances of penetration into the reservoir of the various fluids, as a base case, illustrating the formation of a single filter/sieve, using ethyl formate followed by gel progenitor sodium silicate;

FIG. 1B is a similar depiction except that ethyl acetate is used rather than ethyl formate;

FIG. 2A illustrates the present invention and is a similar depiction as FIG. 1A except that there are two separate injections of ethyl formate and two separate filters/seives are formed;

FIG. 2B illustrates the present invention and is a similar depiction as FIG. 1B except that there are two separate injections of ethyl acetate and two separate filters/sieves are formed;

FIG. 3A illustrates the present invention where a commingled mixture of ethyl formate and ethyl acetate are injected and two separate filters/sieves are formed;

FIG. 3B illustrates the present inventions where there are independent injections of two different reactive partitioning chemicals, ethyl formate and ethyl acetate, and two separate filters/sieves are formed;

FIG. 3C illustrates the present invention where the independent injection of the two different reactive partitioning chemicals, ethyl acetate and ethyl formate are reversed in sequence and two separate filter/sieves are formed.

DETAILED DESCRIPTION OF THE PREFERRED EMBODIMENT

The present invention employs reactive chemicals which are water soluble chemicals having solubility in both water and oil, and which have the ability to undergo reactions at reservoir conditions to form the desired filter/sieves or blockage zones of gel or polymer within an underground formation at desired distances from the well. The process employs either one, or more, organic esters and a silicate or a water-soluble polymer or copolymers and multivalent salts. The process is unique in that the choice of chemicals and the independent or commingle injection of the chemicals into the formation with each chemical bank being pushed further out into the formation with predetermined push volumes of fresh water, treated fresh water, seawater, treated seawater, formation water or treated formation water, results in a predetermined retardation in the flow of the organic ester reactive chemicals by their partitioning interaction with the immobile accessible residual oil in the formation and the ensuing non-retarded flow of the gel or polymer forming chemicals resulting in the gel or polymer forming chemical bank proceeding to catch up to, and superimposing itself upon, the slower moving organic ester reactive chemical banks at predetermined distances and thicknesses from the well bore and at locations ideal for low velocity flow conditions.

In situ hydrolysis reaction of the reactive organic ester chemicals, at reservoir conditions and the subsequent inter-reaction of the organic ester reaction product alcohols and organic acids with the gel or polymer progenitor chemicals results in the formation of two, or more, filter/sieves or blocking zones of stable gel or polymer. The filter/sieves effectively reduce water flow from any preferentially invaded high permeability, high water cut reservoir zones. A unique aspect of the locations of the filter/sieves at desired depths of penetration around a production well is that they allow the oil and/or gas to flow through the filter/sieve, whilst blocking the water flow, thereby allowing commercial improved and/or enhanced oil and/or gas production utilizing the in situ formation drive mechanism.

U.S. Pat. Nos. 6,431,280 and 6,615,918 disclosed specific details of the gel or polymer emplacement process primarily in terms of single filter/sieve or water blockage zone case. The process presented herein specifically relates to the controlled emplacement of two, or more, gel or polymer filter/sieves or water blockages whereby two, or more, volumes of a single reactive organic ester chemical is sequentially injected, independently, into a water producing oil and/or gas well along with appropriate push volumes and spacer volumes of fresh water, treated freshwater, seawater, treated seawater, formation water or treated formation water such that the reactive organic ester banks and the superimposed gel or polymer progenitor chemicals are at the specified depths of penetration into the reservoir formation at which time the well is shut in such that gelation or polymerization can take place at static conditions.

The process of the present invention also applies to the emplacement of two, or more, gel or polymer filter/sieves or water blockages whereby two or more different reactive organic esters, having different partition coefficients, can be sequentially injected into a well, either as independent volumes with appropriate spacer volumes or as a single injection volume in which the two, or more, reactive organic esters are commingled. In the latter commingled case, the reactive organic esters will separate from each other in the reservoir consistent with the varying retardations caused by the partitioning ability of each specific organic ester between the mobile water carrier fluid and the immobile accessible residual oil and/or condensate remaining in the formation pore system.

The benefits of locating two, or more, filter/sieves or water blockage zones within a water productive formation relate to giving one the ability to design and implant larger and more stable gel or polymer blockages at desired depths of penetration with much thicker blockage zones. Also, one can utilize more effectively the inherent different rates of hydrolysis of the selected reactive organic esters such that one can effectively place a less reactive organic ester bank out at a greater distance into the reservoir and then place a fast reactive organic ester bank closer to the well bore. In such a case, the close-to-the-well-bore reactive ester bank can first form an effective filter/sieve or water blockage close to the well bore, which will then allow the less reactive organic ester bank the time required for the necessary degree of hydrolysis to take place and thereby initiate gelation or polymerization at depth whilst still in a static environment.

This two, or more, gel or polymer filter/sieve emplacement process can have general application in oil wells, gas wells, or in depleted high water cut oil and gas wells containing remaining mobile oil, but is particularly applicable to any water productive gas/wet gas well in which the water load in the well bore is preventing recovery of in-place remaining gas reserves. The method is also preferred for use in reservoirs that originally produced oil and/or condensate/wet gas liquids and then became dominantly gas producers and ultimately, uneconomic water producers. These types of reservoirs will still have significant amounts of immobile residual oil and/or condensate/wet gas liquids and gas present in the pore system. Unfortunately, for such types of reservoirs there are usually no samples of oil, or condensate/wet gas liquids available on which the partition coefficient values can be determined for use in the design of the gel or polymer emplacement procedure to be used. Where no partition coefficient information is available, the emplacement of multiple filter/sieve or blockage zones can be achieved by arbitrarily using possible rather than measured partition coefficient values such that the possibility of forming suitable gel or polymer filter/sieve zones will occur.

For filter/sieve or water blockage emplacement in formations which have no residual oil, preconditioning of the formation by oil or diesel injection followed by water flood can render the formation suitable for ensuing gel or polymer blockages according to the described process.

The chemical emplacement and the subsequent gelation or polymerization process is illustrated by a description of a preferred embodiment of the present invention in which two, or more, oil-water partitioning reactive chemicals, ethyl formate and/or ethyl acetate, are injected independently or as a commingle mixture into the well followed by the injection of a second, water soluble chemical, sodium silicate, along with appropriate spacer push volumes calculated to achieve the desired depth of penetration.

To illustrate the versatility of this multiple gel and/or polymer emplacement process designed to inhibit, or effectively stop, water production from a water producing reservoir formation, calculations have been made from the data presented in Examples I-A, I-B, II-A, II-B, III-A, III-B, III-C whereby, for a common set of reservoir criteria and common volumes of conditioning fluids, common volumes of reactive chemicals ethyl formate and ethyl acetate, common volumes of spacer fluids and common volumes of push fluids, the distances of penetration of each volume into the reservoir and the retarded distances of penetration of the partitioning chemicals, ethyl formate and ethyl acetate amongst others, are determined. The locations of the filters/sieves are presented in FIGS. 1-A, 1-B, 2-A, 2-B, 3-A, 3-B, and 3-C.

The common reservoir characteristics chosen for and applied in Examples I-A, I-B, II-A, II-B, III-A, III-B and III-C assume a perforated homogeneous reservoir interval of 10 meters (32.81 feet) thickness, an average porosity of 30%, and an accessible residual oil saturation (ASor) of 30 pv %. The common volumes of injected conditioning fluids, push volumes, spacer volumes and reactive chemical volumes of ethyl formate and ethyl acetate and gel or polymer progenitor chemical sodium silicate volume and the tubular volume are as indicated in each example appropriately as $V_1$, $V_2$, $V_3$, $V_4$, $V_5$, $V_6$ and $V_7$ or, alternatively as $V_1$, $V_2$, $V_3$, $V_4$, $V_5$, $V_6$, $V_7$, $V_8$, and $V_9$.

Partition coefficients postulated for the distribution of ethyl formate between the carrier fluid and the immobile accessible residue oil and/or condensate in the reservoir, $K_{EtFm}$=3.0 with the partition coefficient for ethyl acetate $K_{EtAc}$=6.0.

BASE CASES

The case for a single injection bank of ethyl formate is shown in Example I-A, FIG. 1-A. The results of a single injection bank of ethyl acetate is shown in Example I-B, FIG. 1-B.

EXAMPLE I-A

RADIAL DISTANCE OF PENETRATION FOR VOLUMES $V_1$, $V_2$, $V_3$, $V_4$, $V_5$, $V_6$ AND $V_7$ NOT ADJUSTING FOR ANGULAR AND RADIAL DISPERSION.

| | | | | Radial Distance of Penetration | | | |
|---|---|---|---|---|---|---|---|
| Example I-A | Vol | Volume (bbls) | Accum Volume | rw (ft) | re (ft) | rw (m) | re (m) |
| Tubular Volume | 7 | 100 | 0 | 0.00 | 0.00 | 0.00 | 0.00 |
| Seawater Push | 6 | 100 | 100 | 5.09 | | 1.55 | |
| Seawater/ EDTA Push | 5 | 100 | 200 | 7.21 | | 2.20 | |
| Seawater/ EDTA/Gel Progenitor | 4 | 700 | 900 | 15.29 | | 4.66 | |
| Seawater/ EDTA Push | 3 | 100 | 1000 | 16.11 | 10.67 | 4.91 | 3.25 |
| Chemical Mix EtFm | 2 | 600 | 1600 | 20.38 | 13.50 | 6.21 | 4.11 |
| Waterflood Seawater | 1 | 500 | 2100 | 23.35 | | 7.12 | |

In this example, the filter/sieve or gel formation zone resulting from the superimposed ethyl formate and sodium silicate volumes (4+2e) is between 10.67 feet and 13.50 feet (thickness 2.83 feet) within the silicate bank (4) between 7.21 feet and 15.29 feet (8.08 feet thick). The entire volume of fluids injected into the well totaled 2100 bbls and penetrated a total radial distance into the reservoir of 23.35 feet from the well bore. As shown in FIG. 1A the volume of seawater (1) is followed by the depleted carrier (water) for the ethyl formate ($2_w$) and the seawater push (3); the gel progenitor (4) moves faster than the ethyl formate, whereby the gel progenitor overtakes the reactive organic ester; and is followed by the seawater push (6) and the tublar volume (7). In the other figures of the drawings, these designations are used whether there are seven or nine volumes injected.

In the above example, and subsequent examples, rw(ft) refers to the radial distance of penetration from the well bore following the respective injected accumulative volume of fluid.

Hence, the last injected volume, $V_7$, only displaces the well bore volume (100 bbls) and the radial distance of penetration into the reservoir is zero. Similarly, the maximum radial distance of fluid penetration, 23.35 feet, is computed on the accumulative test injection volume of 2,100 bbls.

The re(ft) refers to the distance of penetration achieved by the reactive chemical bank at its leading edge and at its trailing edge following its retardation resulting from its partitioning action with the immobile accessible residual oil in the formation. The computed re(ft) values for the ethyl formate and ethyl acetate allows one to calculate the filter/sieve or gel blockage thicknesses at the distance required in the reservoir.

EXAMPLE I-B

RADIAL DISTANCE OF PENETRATION FOR VOLUMES $V_1$, $V_2$, $V_3$, $V_4$, $V_5$, $V_6$ AND $V_7$ NOT ADJUSTING FOR ANGULAR AND RADIAL DISPERSION.

| | | | | Radial Distance of Penetration | | | |
|---|---|---|---|---|---|---|---|
| Example I-B | Vol | Volume (bbls) | Accum Volume | rw (ft) | re (ft) | rw (m) | re (m) |
| Tubular Volume | 7 | 100 | 0 | 0.00 | 0.00 | 0.00 | 0.00 |
| Seawater Push | 6 | 100 | 100 | 5.09 | | 1.55 | |
| Seawater/ EDTA Push | 5 | 100 | 200 | 7.21 | | 2.20 | |
| Seawater/ EDTA/Gel Progenitor | 4 | 700 | 900 | 15.29 | | 4.66 | |
| Seawater/ EDTA Push | 3 | 100 | 1000 | 16.11 | 8.53 | 4.91 | 2.60 |
| Chemical Mix EtAc | 2 | 600 | 1600 | 20.38 | 10.79 | 6.21 | 3.29 |
| Waterflood Seawater | 1 | 500 | 2100 | 23.35 | | 7.12 | |

In this example, the relative slower flow velocity of the reactive partitioning chemical, ethyl acetate, as a function of its higher partition coefficient value, results in a gel formation zone between 8.53 feet and 10.79 feet (2.26 feet thick).

ILLUSTRATIONS OF THE PRESENT INVENTION

To obtain two filter/sieves or gel/polymer formation zones, one embodiment employs an injection sequence using two reactive chemical volumes of an organic ester separated by a spacer volume. This injection sequence is shown in Examples II-A and II-B for two volumes of ethyl formate and two volumes of ethyl acetate respectively.

EXAMPLE II-A

RADIAL DISTANCE OF PENETRATION FOR VOLUMES $V_1$, $V_2$, $V_3$, $V_4$, $V_5$, $V_6$, $V_7$, $V_8$ AND $V_9$ NOT ADJUSTING FOR ANGULAR AND RADIAL DISPERSION.

| | | | | Radial Distance of Penetration | | | |
|---|---|---|---|---|---|---|---|
| Example II-A | Vol | Volume (bbls) | Accum Volume | rw (ft) | re (ft) | rw (m) | re (m) |
| Tubular Volume | 9 | 100 | 0 | 0.00 | 0.00 | 0.00 | 0.00 |
| Seawater Push | 8 | 100 | 100 | 5.09 | | 1.55 | |
| Seawater/ EDTA Push | 7 | 100 | 200 | 7.21 | | 2.20 | |
| Seawater/ EDTA/Gel Progenitor | 6 | 700 | 900 | 15.29 | | 4.66 | |
| Seawater/ EDTA Push | 5 | 100 | 1000 | 16.11 | 10.67 | 4.91 | 3.25 |
| Chemical Mix EtFm | 4 | 250 | 1250 | 18.02 | 11.93 | 5.49 | 3.64 |
| Seawater/ EDTA Push | 3 | 100 | 1350 | 18.72 | 12.40 | 5.71 | 3.78 |
| Chemical Mix EtFm | 2 | 250 | 1600 | 20.38 | 13.50 | 6.21 | 4.11 |
| Waterflood Seawater | 1 | 500 | 2100 | 23.35 | | 7.12 | |

In this case, the two reactive ethyl formate banks are located at 10.67 feet to 11.93 feet (1.26 feet thick) and 12.40 feet to 13.50 feet (1.10 feet thick). A spacer volume of sodium silicate gel progenitor of 0.47 feet thick exists between them, since the entire silicate bank exists between 7.21 feet and 15.29 feet (8.08 feet thick) and is also superimposed upon each of the two reactive chemical banks described.

It will be noted that the actual total volume of reactive ethyl formate chemical used in this case was reduced to two volumes each of 250 bbls; that is a reduction of 16.6% in chemical usage. It is suggested that in this configuration, the silicate spacer volume entrapped between the two ethyl formate banks will in fact also undergo induced gelation bringing about a total bank between 10.67 feet and 13.50 feet (2.83 feet thick).

EXAMPLE II-B

RADIAL DISTANCE OF PENETRATION FOR VOLUMES $V_1$, $V_2$, $V_3$, $V_4$, $V_5$, $V_6$, $V_7$, $V_8$ AND $V_9$ NOT ADJUSTING FOR ANGULAR AND RADIAL DISPERSION.

| | | | | Radial Distance of Penetration | | | |
|---|---|---|---|---|---|---|---|
| Example II-B | Vol | Volume (bbls) | Accum Volume | rw (ft) | re (ft) | rw (m) | re (m) |
| Tubular Volume | 9 | 100 | 0 | 0.00 | 0.00 | 0.00 | 0.00 |
| Seawater Push | 8 | 100 | 100 | 5.09 | | 1.55 | |
| Seawater/ EDTA Push | 7 | 100 | 200 | 7.21 | | 2.20 | |
| Seawater/ EDTA/Gel Progenitor | 6 | 700 | 900 | 15.29 | | 4.66 | |
| Seawater/ EDTA Push | 5 | 100 | 1000 | 16.11 | 8.53 | 4.91 | 2.60 |
| Chemical Mix EtAc | 4 | 250 | 1250 | 18.02 | 9.53 | 5.49 | 2.90 |
| Seawater/ EDTA Push | 3 | 100 | 1350 | 18.72 | 9.91 | 5.71 | 3.02 |
| Chemical Mix EtAc | 2 | 250 | 1600 | 20.38 | 10.79 | 6.21 | 3.29 |
| Waterflood Seawater | 1 | 500 | 2100 | 23.35 | | 7.12 | |

Similar results are indicated for the injection of two reactive chemical ethyl acetate volumes which will result in reactive ethyl acetate banks at 8.53 feet to 9.53 feet (1.00 feet thick) and 9.91 feet to 10.79 feet (0.88 feet thick). The entrapped silicate spacer volume is located at 9.53 feet to 9.91 feet (0.38 feet thick). Again there is a potential saving of 16.6% of reactive chemical usage and it is likely that the intermediate silicate bank will also undergo subsequent gelation; that is between 8.53 feet to 10.79 feet (2.26 feet thick).

A further advantage using multiple reactive chemical volume injections lies in the fact that within each partitioning reactive chemical bank the ester concentration in the immobile accessible residual oil or condensate will take on a binomial concentration distribution profile with the ester concentration increasing to the partition coefficient value times the injection concentration value; for instance, if the concentration of the ethyl formate and ethyl acetate used in the above example had a value of X volume percent, then the maximum concentration attained within each reactive chemical bank during the injection phase would increase from a value of X % to a value of 3X % and 6X % for the ethyl formate and the ethyl acetate chemicals respectively. These enhanced ester concentrations are optimum for stable gel formation to occur at the desired depths of penetration into the reservoir.

It is also possible to inject two, or more, reactive chemical volumes as a single commingled concentrations of the individual esters. This option is illustrated in Example III-A

EXAMPLE III-A

RADIAL DISTANCE OF PENETRATION FOR VOLUMES $V_1$, $V_2$, $V_3$, $V_4$, $V_5$, $V_6$ AND $V_7$ NOT ADJUSTING FOR ANGULAR AND RADIAL DISPERSION.

| | | | | Radial Distance of Penetration | | | | | |
|---|---|---|---|---|---|---|---|---|---|
| Example III-A | Vol | Volume (bbls) | Accum Volume | rw (ft) | EtAc re (ft) | EtFm re (ft) | re (m) | EtAc re (m) | EtFm re (m) |
| Tubular Volume | 7 | 100 | 0 | 0.00 | 0.00 | 0.00 | 0.00 | 0.00 | 0.00 |
| Seawater Push | 6 | 100 | 100 | 5.09 | | | 1.55 | | |
| Seawater/EDTA Push | 5 | 100 | 200 | 7.21 | | | 2.20 | | |
| Seawater/EDTA/Gel Progenitor | 4 | 700 | 900 | 15.29 | | | 4.66 | | |
| Seawater/EDTA Push | 3 | 100 | 1000 | 16.11 | 8.53 | 10.67 | 4.91 | 2.60 | 3.25 |
| Chemical Mix EtAc/EtFm | 2 | 600 | 1600 | 20.38 | 10.79 | 13.50 | 6.21 | 3.29 | 4.11 |
| Waterflood Seawater | 1 | 500 | 2100 | 23.35 | | | 7.12 | | |

In this example, the separation of the two different reactive chemicals takes place within the reservoir formation due to the differing partition coefficient values causing the reactive chemical with the lower partition coefficient traveling further out into the reservoir than the reactive chemical with the greater partition coefficient. For the case shown in Example III-A, the ethyl formate ($K_{EtFm}$=3.0) will be located between 10.67 feet and 13.50 feet (2.83 feet thick) with the ethyl acetate ($K_{EtAc}$=6.0) located at 8.53 feet to 10.79 feet (2.26 feet thick). As can be seen in FIG. 3-A, in this case there is a thin mixed ester zone between 10.67 feet and 10.79 feet (0.12 feet thick); however, it is also apparent that the effective gel-forming interval between 8.53 feet and 13.50 feet should provide an effective 4.97 foot zone for water stoppage.

Both reactive chemical volumes of ethyl formate and ethyl acetate can also be injected sequentially with or without a spacer volume between them. The injection order of each ester will determine the distances of penetration into the reservoir as well as the distances of separation between the two reactive ester banks. This operational consequence is illustrated in FIGS. 3-B and 3-C.

EXAMPLE III-B

RADIAL DISTANCE OF PENETRATION FOR VOLUMES $V_1$, $V_2$, $V_3$, $V_4$, $V_5$, $V_6$, $V_7$, $V_8$ AND $V_9$ NOT ADJUSTING FOR ANGULAR AND RADIAL DISPERSION.

| | | | | Radial Distance of Penetration | | | |
|---|---|---|---|---|---|---|---|
| Example III-B | Vol | Volume (bbls) | Accum Volume | rw (ft) | re (ft) | rw (m) | re (m) |
| Tubular Volume | 9 | 100 | 0 | 0.00 | 0.00 | 0.00 | 0.00 |
| Seawater Push | 8 | 100 | 100 | 5.09 | | 1.55 | |
| Seawater/EDTA Push | 7 | 100 | 200 | 7.21 | | 2.20 | |

-continued

RADIAL DISTANCE OF PENETRATION FOR VOLUMES $V_1$, $V_2$, $V_3$, $V_4$, $V_5$, $V_6$, $V_7$, $V_8$ AND $V_9$ NOT ADJUSTING FOR ANGULAR AND RADIAL DISPERSION.

| | | | | Radial Distance of Penetration | | | |
|---|---|---|---|---|---|---|---|
| Example III-B | Vol | Volume (bbls) | Accum Volume | rw (ft) | re (ft) | rw (m) | re (m) |
| Seawater/EDTA/Gel Progenitor | 6 | 700 | 900 | 15.29 | | 4.66 | |
| Seawater/EDTA Push | 5 | 100 | 1000 | 16.11 | 8.53 | 4.91 | 2.60 |
| Chemical Mix EtAc | 4 | 250 | 1250 | 18.02 | 9.54 | 5.49 | 2.91 |
| Seawater/EDTA Push | 3 | 100 | 1350 | 18.72 | 12.40 | 5.71 | 3.78 |
| Chemical Mix EtFm | 2 | 250 | 1600 | 20.38 | 13.50 | 6.21 | 4.11 |
| Waterflood Seawater | 1 | 500 | 2100 | 23.35 | | 7.12 | |

This example clearly shows that injecting the faster traveling reactive ester volume, ethyl formate, before the slower moving reactive ester volume, ethyl acetate, results in the greatest degree of separation of the two banks out in the reservoir formation. The ethyl formate bank is located at 12.40 feet to 13.50 feet (1.10 feet thick) whereas the second injected ethyl acetate bank is located between 8.53 feet to 9.54 feet (1.01 feet thick). The degree of separation between the two ester reactive chemical banks, ethyl formate and ethyl acetate, has a thickness of 2.86 feet which contains potentially gel or polymer forming chemical.

EXAMPLE III-C

RADIAL DISTANCE OF PENETRATION FOR VOLUMES $V_1$, $V_2$, $V_3$, $V_4$, $V_5$, $V_6$, $V_7$, $V_8$ AND $V_9$ NOT ADJUSTING FOR ANGULAR AND RADIAL DISPERSION.

| | | | | Radial Distance of Penetration | | | |
|---|---|---|---|---|---|---|---|
| Example III-C | Vol | Volume (bbls) | Accum Volume | rw (ft) | re (ft) | rw (m) | re (m) |
| Tubular Volume | 9 | 100 | 0 | 0.00 | 0.00 | 0.00 | 0.00 |
| Seawater Push | 8 | 100 | 100 | 5.09 | | 1.55 | |
| Seawater/ EDTA Push | 7 | 100 | 200 | 7.21 | | 2.20 | |
| Seawater/ EDTA/Gel Progenitor | 6 | 700 | 900 | 15.29 | | 4.66 | |
| Seawater/ EDTA Push | 5 | 100 | 1000 | 16.11 | 10.67 | 4.91 | 3.25 |
| Chemical Mix EtFm | 4 | 250 | 1250 | 18.02 | 11.93 | 5.49 | 3.64 |
| Seawater/ EDTA Push | 3 | 100 | 1350 | 18.72 | 9.91 | 5.71 | 3.02 |
| Chemical Mix EtAc | 2 | 250 | 1600 | 20.38 | 10.79 | 6.21 | 3.29 |
| Waterflood Seawater | 1 | 500 | 2100 | 23.35 | | 7.12 | |

This example illustrates the effects of first injecting the slower moving reactive chemical volume, in this case ethyl acetate, followed by the injection of the faster moving reactive chemical volume, ethyl formate. The ethyl formate volume proceeds to catch up to the ethyl acetate bank and passes further out into the reservoir formation. As a consequence, as is shown in FIG. 3-C, the ethyl acetate bank will be located at 9.91 feet to 10.79 feet (0.88 feet thick) with the ethyl formate bank located at 10.67 feet to 11.93 feet (1.26 feet thick). As was the case illustrated in Example III-A, FIG. 3-A, there is an overlap zone (0.12 feet) between the two reactive chemical banks.

It will be readily appreciated that this invention features several specific advantages. First, the invention allows the operator to predetermine the locations of the filter/sieves or blocking gels or polymers at specific depths in the reservoir formation. Second, the invention allows the operator to determine the thicknesses of the filter/sieves or blocking zones. Third, the invention gives the operator greater control over the placements and thicknesses of the filter/sieves or blocking gels or polymers than ever before. The reactive chemicals participating in the gels or polymers formation can be independently injected into the reservoir, or can be injected as a single commingle injection volume, and the volumes and concentrations can be accurately controlled to achieve the desired results. Fourth, by design, the previously ubiquitous problems of premature chemical reaction are not possible in the practice of the invention. The gels or polymer forming chemicals only come into contact with one another at the predetermined location and depth in the reservoir. Fifth, the placement of the blocking gel or polymer chemicals will be preferentially located in high permeability zones present in the reservoir formation. As a consequence, unwanted water flow into and out of these high permeability zones will be preferentially diminished once gelation or polymerization and formation of the filter/sieves or water blockages has occurred. Sixth, all chemical solutions used in this process have low viscosity values between 1 and 5 cps (centipoises) and hence behave in a manner close to water itself. Injection of these low viscosity fluids will take place preferentially into the high permeability high water cut zones from which water production is the greatest, but more importantly, will be injected proportionally into which ever zones the water flow is coming from into the well. Seventh, the emplacement of two, or more, different reactive chemical volumes, which have different partition coefficients, allows one to take advantage of the different rates of hydrolysis of the reactive chemicals injected. For instance, in the emplacement cited in Examples III-A, III-B, III-C and FIGS. 3-A, 3-B, 3-C, the rates of hydrolysis at reservoir temperatures is much faster for ethyl formate than it is for ethyl acetate with rate constants being approximately $k_{EtFm}$=0.5 days$^{-1}$ and $k_{EtAc}$=0.1 days$^{-1}$ for a given reservoir temperature and water salinity. Since the lower partitioning reactive chemical travels the farthest into the reservoir, the rapid formation of a stable gel or polymer bank at this location allows the less reactive chemical the time necessary to undergo complete hydrolysis whilst still in a static location. Eighth the process allows the concentration of the reactive chemicals to increase as a function of the partition coefficient values of each reactive chemical used. For instance, ethyl formate has a greater solubility in the water phase than it does in the immobile accessible residual oil and/or condensate present in the reservoir pore system, whereas, other reactive organic esters such as ethyl acetate, propyl acetate, among others, have greater solubilities in the oil and/or condensate phase and consequently, have less solubility in the aqueous phase. Since it is desirable to inject a true solution of each reactive chemical volume, the concentration of each reactive chemical in the water phase has a maximum value, a value which may, or may not, be of the correct molar concentration to effectively generate sufficient acid and alcohol products required to initiate adequate gelation or polymerization of the superimposed gel or polymer progenitor chemical.

The partitioning of initially injected comparatively low concentrations of the reactive ester chemicals results in an in situ increase of each of the reactive ester chemicals within the immobile accessible residual oil or condensate phase such that the molar concentrations needed for effective gelation or polymerization can be achieved. As discussed previously, active partitioning of ethyl formate will increase the maximum concentration in the injected and retarded ethyl formate bank from an injection concentration of X volume percent to a 3X volume percent level. Similarly, for ethyl acetate an initial concentration of X will increase to a maximum concentration of 6X.

In the forgoing Examples, the reactive partitioning chemical $R_1$ or $R_2$ is illustrated by the organic esters, ethyl formate or ethyl acetate and the gel or polymer progenitor is illustrated by sodium silicate. Reference is made to the disclosure of U.S. Pat. Nos. 6,431,280 and 6,615,918 that illustrates that a large number of sequences or chemicals are possible to be used in the present invention to produce the multiple filter/sieves, that are either gels or polymers.

A further feature of the present invention is to fill the tubulars with a final volume of push fluid equal to the wellbore volume such that only the total fluid volume entering the formation results in the emplacement of the gel or polymer filter/sieves or water blockage zones at the desired depths of penetration from the wellbore. It can be of significant economic benefit if, upon having injected the design quantities of gel or polymer chemical, spacer, and push volumes, the final wellbore volume injected into the well is an inert gas, diesel, crude oil or mixtures thereof. The well is then shut in to enable gelation or polymerization to take place under static conditions in the reservoir.

The use of an inert gas, condensate, diesel or crude oil wellbore volume as described can remove the need for unloading the well. In the case of using an inert gas such as nitrogen, the wellbore will be filled with the volume of gas required to attain the pressure in the reservoir, but, in point of fact, as the water is pushed back to a certain point into the formation the reservoir will begin to flow gas into the wellbore and will only cease once the reservoir pressure has been reached. Opening the well to production should result in economic production.

In the case of using condensate/diesel or crude oil to fill the wellbore volume, there will be approximately an 18%–20% reduction in the weight of fluid in the wellbore. As the fluid weight decreases in the wellbore the reservoir will begin to contribute gas and oil fluids to commingle with the injected condensate, diesel or crude oil. Upon shutting in the well, ongoing solution of gas and oil/condensate fluids into the wellbore fluids will occur.

We claim:

1. A method of placing two, or more, effective filter/sieves or water blockage zones, at desired depths of penetration into a water producing oil/or gas reservoir such that oil and or gas production can be re-established, the method comprising:

a. injecting a first carrier fluid containing a reactive partitioning chemical $R_1$ into the well b. injecting a spacer fluid into the well;

c. injecting a second carrier fluid containing a second reactive partitioning chemical $R_2$ into the well, wherein the second reactive partitioning chemical $R_2$ can be the same as the first reactive partitioning chemical $R_1$, or a different reactive partitioning chemical, which will have a different partitioning coefficient value to the partitioning coefficient value of $R_1$;

d. injecting a second spacer fluid into the well; and e. injecting a gel or polymer progenitor fluid into the well.

2. The method of claim 1 which further includes injecting a conditioning fluid prior to injecting said first fluid.

3. The method of claim 1 wherein the partitioning reactive chemical(s) $R_1$ and $R_2$ are selected from the group consisting of methyl formate, ethyl formate, propyl formate, methyl acetate, ethyl acetate, propyl acetate, methyl proprionate, ethyl proprionate, and propyl proprionate, and where $R_1$ and $R_2$ can be the same ester or a combination of different esters.

4. The method of claim 1 wherein the wellbore is filled with inert nitrogen gas, carbon dioxide gas, methane gas, condensate liquids, diesel liquids or crude oil liquids or mixtures thereof.

5. The method of claim 1 wherein at least one, or more of the reactive chemical(s) or gel/polymer progenitor chemical(s) must have partition coefficient value(s) $K_1$ greater than zero, $K_0$, with the other chemical(s) required for gel or polymer formation having partition coefficient(s) equal to zero, $K_0$, or a partition coefficient value(s) greater than zero but less than $K_1$.

6. The method of claim 5 whereby partitioning reactive chemical(s) and partitioning, or non-partitioning, gel/polymer progenitor chemicals are sequentially injected into the well in the order determined by their respective partition coefficient value.

7. A method of placing two, or more, effective filter/sieves or water blockage zones, at desired depths of penetration into a water producing oil or gas reservoir such that oil and /or gas can be reestablished, the method comprising:

a. injecting a first carrier fluid containing a commingled mixture of reactive partioning chemicals $R_1$ and $R_2$ wherein the partitioning reactive chemical(s) $R_1$ and $R_2$ are organic esters, into the well;

b. injecting a spacer fluid into the well; and c. injecting a gel or polymer progenitor fluid into the well.

* * * * *